US006123648A

United States Patent [19]

Stevens

[11] Patent Number: 6,123,648

[45] Date of Patent: Sep. 26, 2000

[54] WHEEL ASSEMBLY FOR A TREADMILL

[76] Inventor: Clive Graham Stevens, 372 Hills Borough Road, Auckland, New Zealand

[21] Appl. No.: 09/283,257

[22] Filed: Apr. 1, 1999

[51] Int. Cl.[7] ..... A63B 22/02

[52] U.S. Cl. ..... 482/54; 482/51

[58] Field of Search ..... 482/51, 52, 54, 482/57, 61, 70, 71, 148

[56] References Cited

U.S. PATENT DOCUMENTS 5,591,106 1/1997 Dalebout et al. ..... 482/54

5,674,453 10/1997 Watterson et al. ..... 482/54

5,904,637 5/1999 Kuo ..... 482/54

*Primary Examiner*—Glenn E. Richmon

*Attorney, Agent, or Firm*—Charles E. Baxley, Esq.

[57] ABSTRACT

A treadmill includes two stands each having a transverse portion and a continuous belt is pivotally connected between the two stands. Each transverse portion has a recess defined radially therein for receiving a wheel therein. The two wheels each have a rotational axis perpendicular to the longitudinal axis of the transverse portion corresponding thereto so that the continuous belt can be folded between the two stands and the folded treadmill can be moved laterally by the two wheels.

4 Claims, 5 Drawing Sheets

WHEEL ASSEMBLY FOR A TREADMILL

FIELD OF THE INVENTION

The present invention relates to a wheel assembly used on a treadmill, and more particularly, to a wheel assembly connected to each transverse portion of the two respective stands between which the continuous belt is connected. Each wheel assembly has a rotational axis perpendicular to the axis of the transverse portion so that the treadmill can be moved in the lateral direction.

BACKGROUND OF THE INVENTION

A conventional treadmill is shown in FIG. 1 and includes two stands 12 each includes a handle 1 on the upper end and a transverse portion 11 on the lower end. A continuous belt 10 is disposed inclinedly between the two stands 12 so that a user may hold the handles 1 with his/her hands and running on the continuous belt 10. In order to conveniently store the treadmill in a small space, the continuous belt 10 can be folded between the two stands 12 as shown in FIG. 2. Each transverse portion 11 has a wheel 13 whose rotational axis is parallel to the axis of the transverse portion 11 corresponding thereto. When the continuous belt 10 is folded between the two stands 12, the whole treadmill can be moved conveniently by rolling the wheels 13. However, generally, the width of each transverse portion 11 is larger than the width of the entrance of a room so that the user has to push the treadmill at an angle relative to the entrance to move the treadmill into the room. Furthermore, the user has to stand between the two stands 12, and this location is inconvenient for the user to move forward because the user's feet could contact the lower end of the continuous belt 10.

The present invention intends to provide a wheel assembly connected to the transverse portion of each stand, and each wheel assembly has its rotational axis perpendicularly to the axis of the transverse portion corresponding thereto so that the folded treadmill can be moved laterally with the user standing beside the continuous belt.

The wheel assembly of the present invention effectively improves the shortcoming of the conventional wheel assembly of the treadmill.

SUMMARY OF THE INVENTION

In accordance with one aspect of the present invention, there is provided a combination of a wheel assembly and a treadmill. The treadmill comprises two stands each having a transverse portion. A continuous belt is pivotally connected between the two stands. Each transverse portion has two wheels rotatably connected thereto and each wheel has a rotational axis perpendicularly to an axis of the transverse portion corresponding thereto.

The main object of the present invention is to provide a wheel assembly connected to the transverse portion of each stand of a treadmill such that the treadmill can be moved laterally by the wheels.

Another object of the present invention is to provide a wheel assembly for a treadmill which can be moved with the narrow side passing through the entrance of a room.

Further objects, advantages, and features of the present invention will become apparent from the following detailed description with appropriate reference to the accompanying drawings.

DETAILED DESCRIPTION OF THE PREFERRED EMBODIMENT

Figure 1:
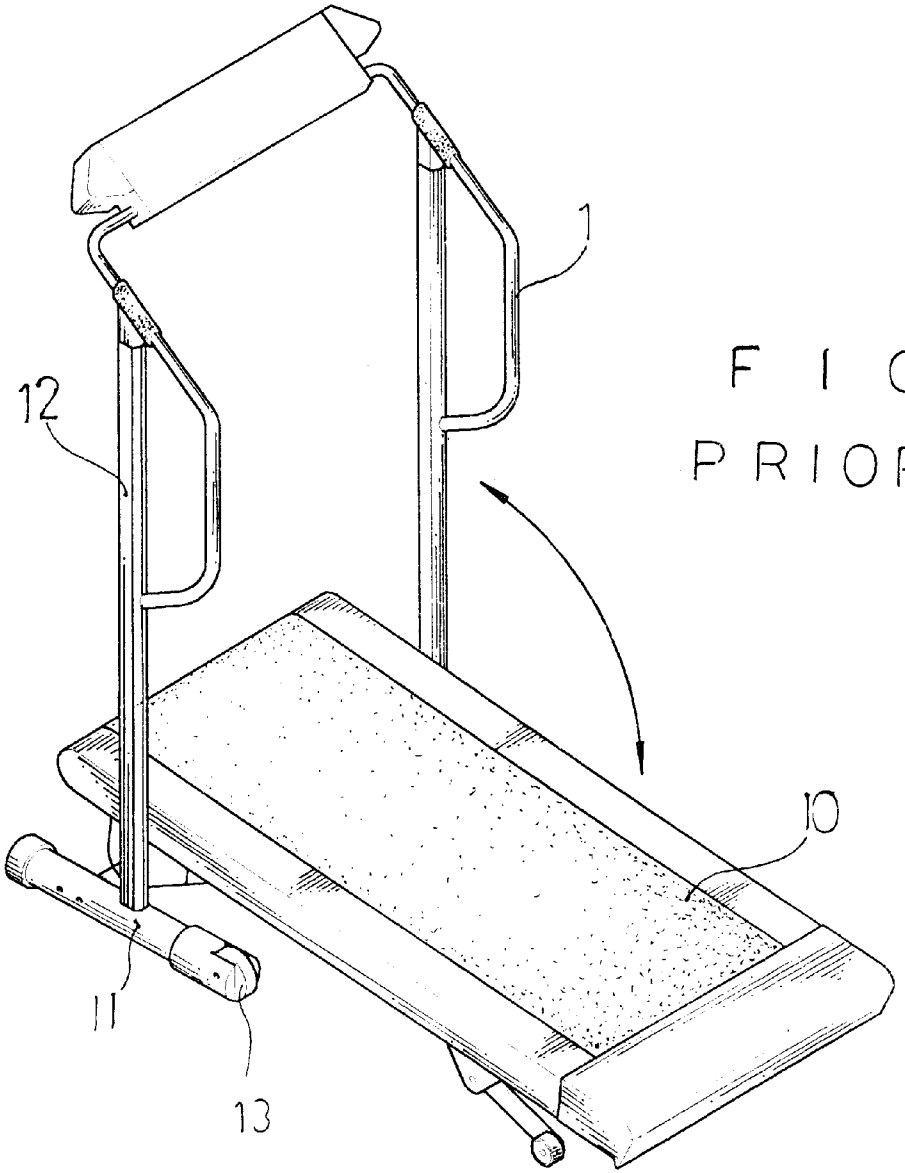
FIG. 1 PRIOR ART
FIG. 1 is a perspective view of a conventional treadmill.
Figure 2:
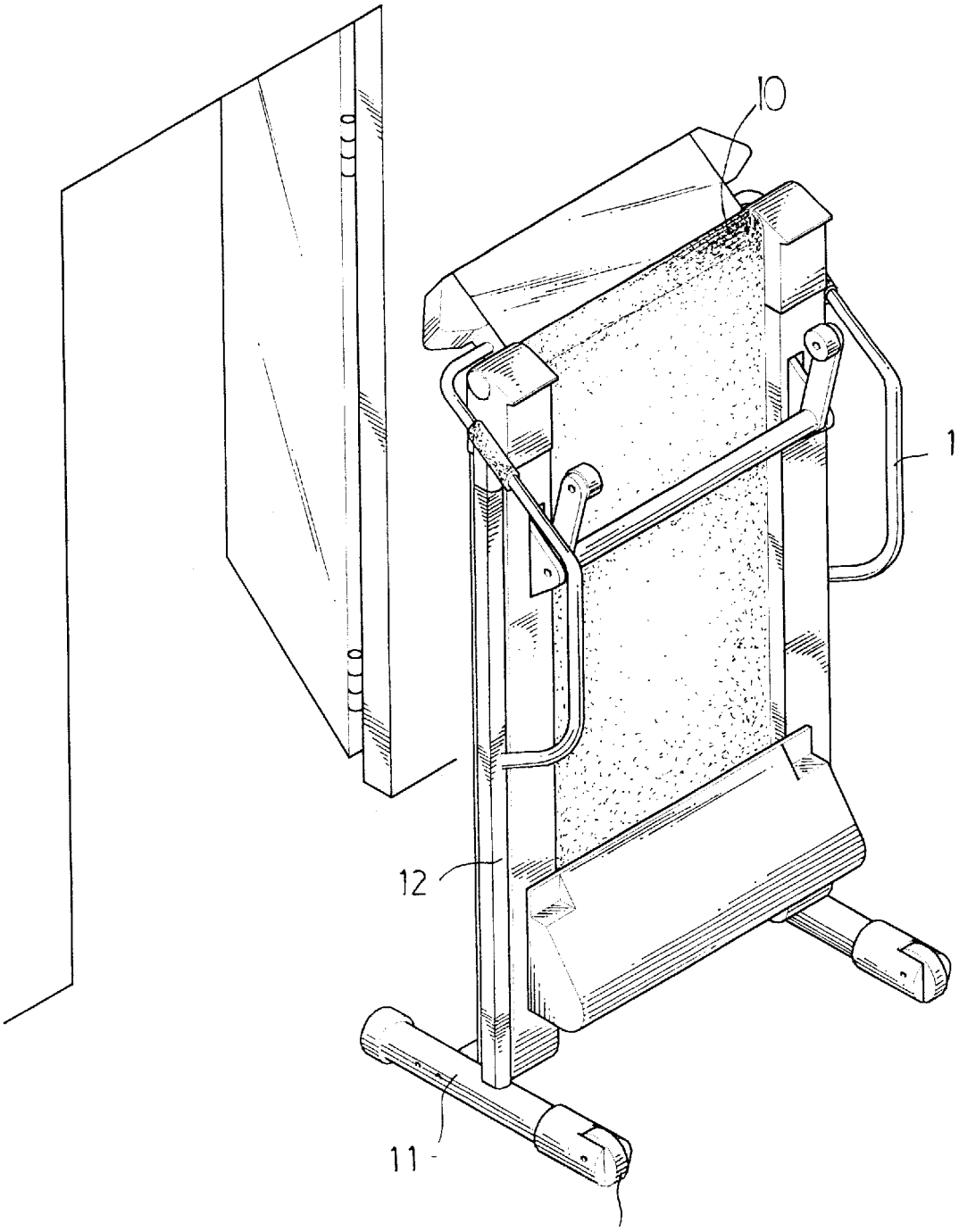
FIG. 2 PRIOR ART
FIG. 2 is a perspective view of the folded conventional treadmill to be moved into a room.
Figure 3:
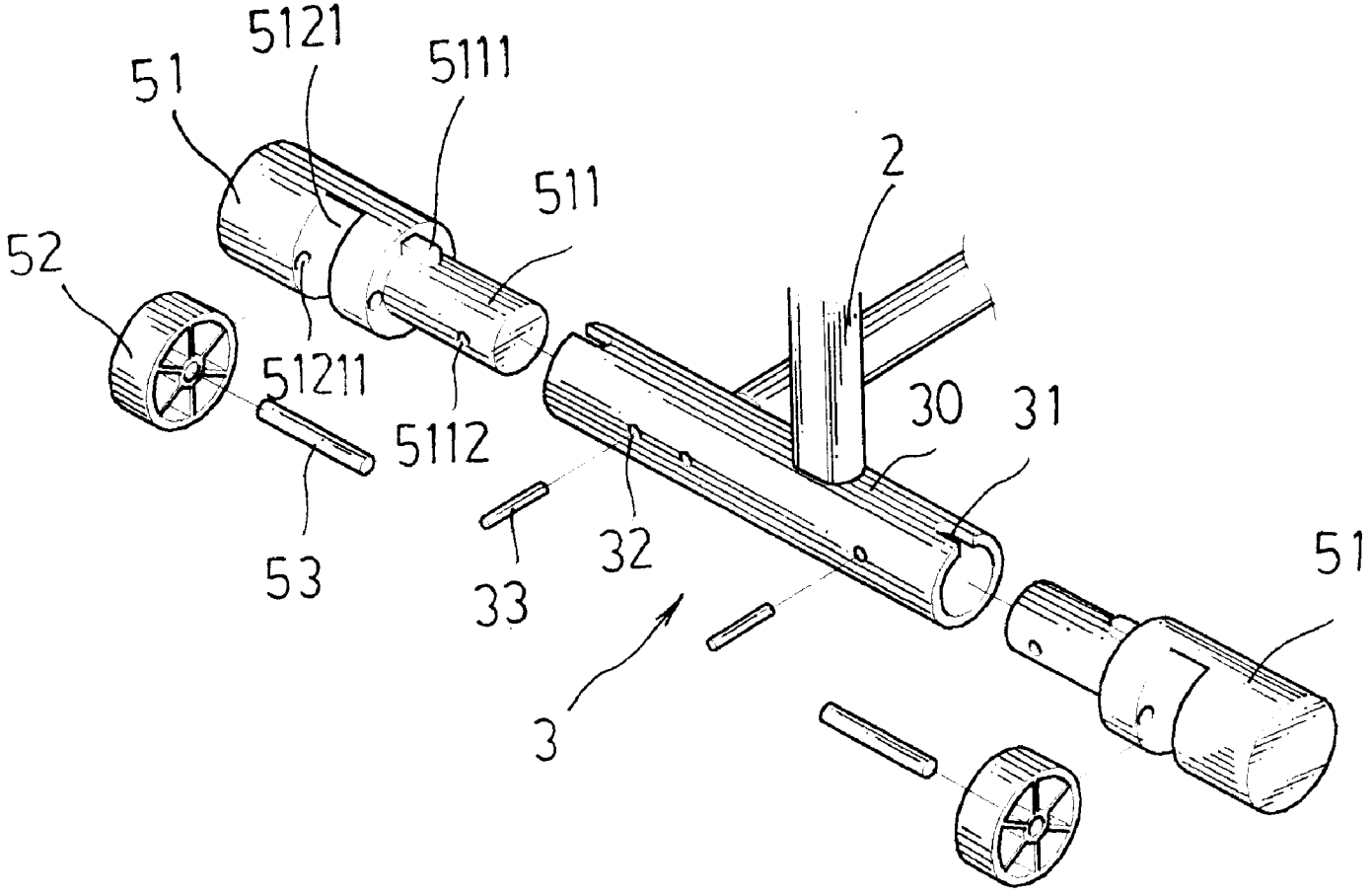
FIG. 3 is an exploded view of the wheel assembly in accordance with the present invention.
Figure 4:
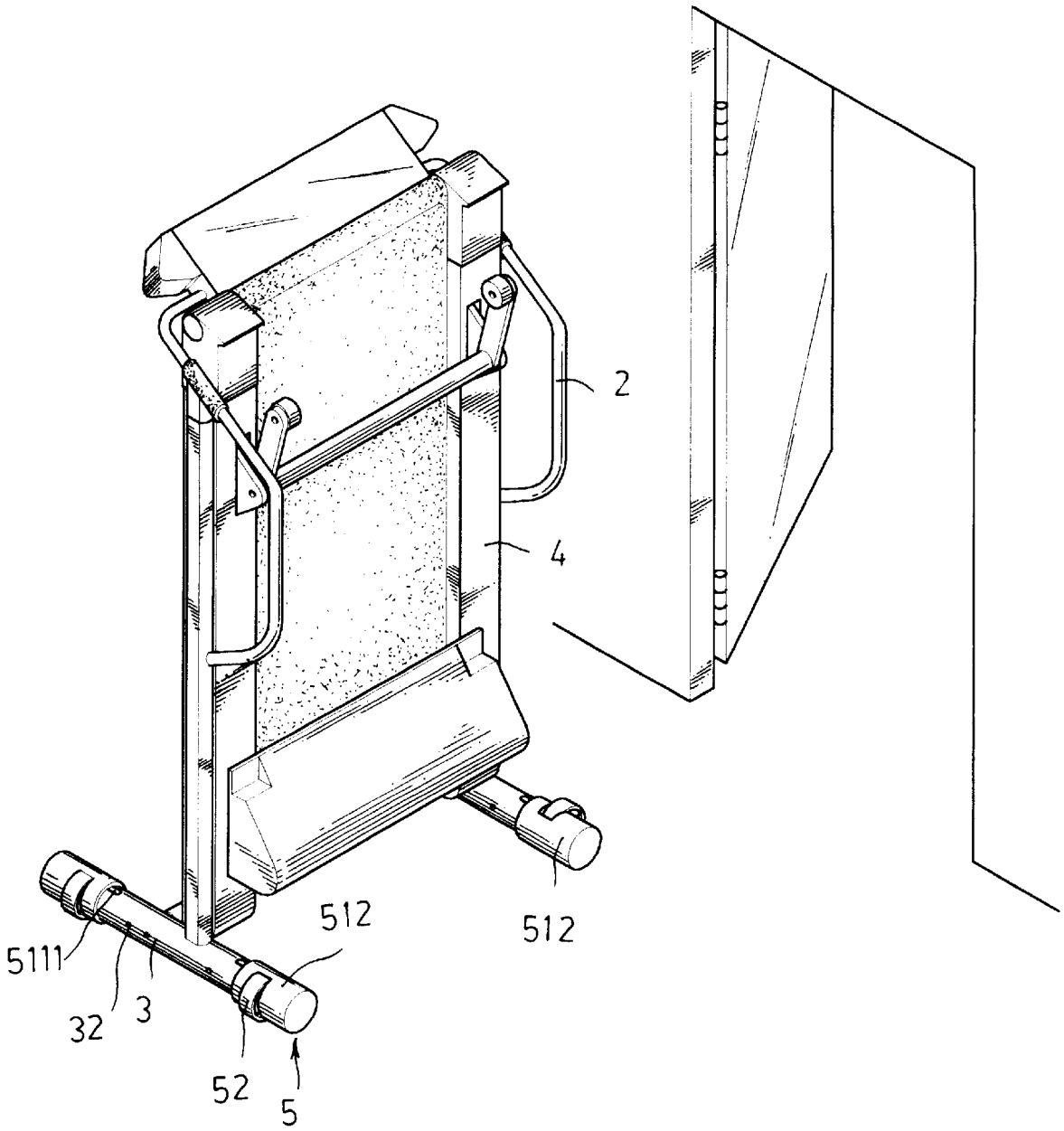
FIG. 4 is a perspective view of the folded treadmill in accordance with the present invention to be moved into a room.
Figure 5:
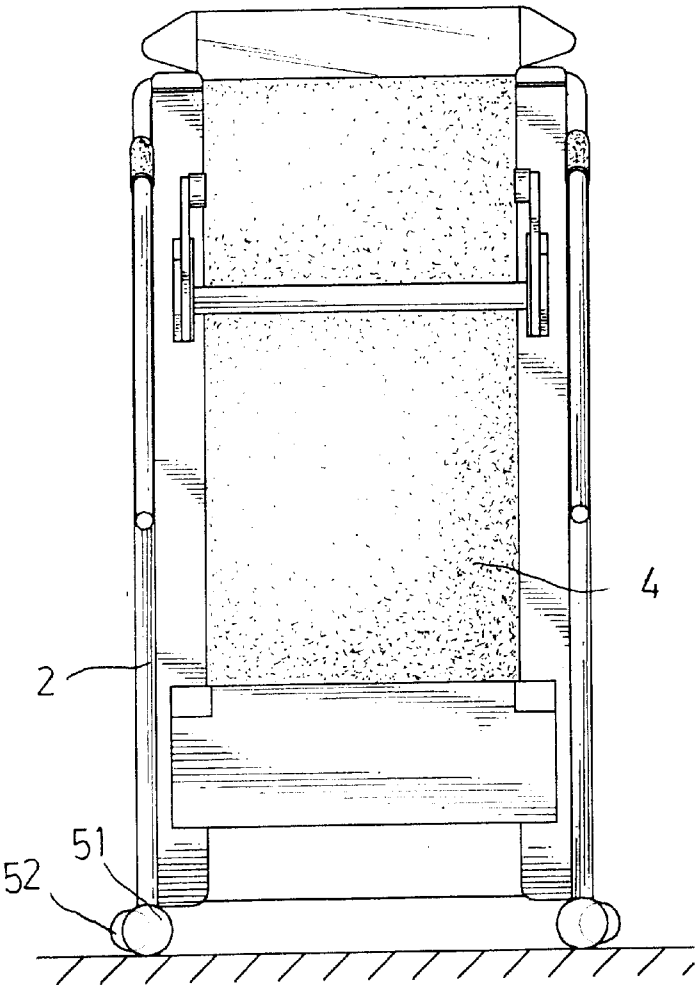
FIG. 5 is plane view to show the treadmill with the continuous belt folded between two stands a side elevational view.

Referring to FIGS. 3 and 5, the treadmill in accordance with the present invention comprises two stands 2 each having a transverse portion 3 so as to firmly stand on the ground. A continuous belt 4 is pivotally connected between the two stands 2 so that the continuous belt 4 can be folded between the two stands 2 as shown in FIGS. 4 and 5. Each transverse portion 3 comprises a middle tube 30 and two end caps 51 which are respectively connected to two ends of the middle tube 30. Each of the end caps 51 has a recess 5121 defined radially therein and two apertures 51211 are respectively defined in the two ends defining the recess 5121 as to receive a wheel 52 in the recess 5121 by extending a pin 53 through the wheel 52 and the two apertures 51211. Each wheel 52 has a rotational axis perpendicularly to an axis of the transverse portion 3 corresponding thereto.

Each middle tube 30 has a notch 31 defined longitudinally in each one of two ends thereof. Each of the two end caps 51 has a neck 511 extending therefrom so as to be received in the corresponding end of the middle tube 30. Each neck 511 further has a protrusion 5111 extending radially outward therefrom so as to be engaged with the notch 31 corresponding thereto.

Each middle tube 30 has at least two holes 32 respectively defined through the wall at two ends thereof and each neck 511 has a positioning hole 5112 defined therein. When the two necks 511 are respectively inserted into the two ends of the middle tube 30, the two holes 32 are respectively located in alignment with the positioning holes 5112 in the two necks 511. Two pins 33 are respectively inserted through the aligned hole 32 and positioning hole 5112 to position the two end caps 51.

Figure 6:
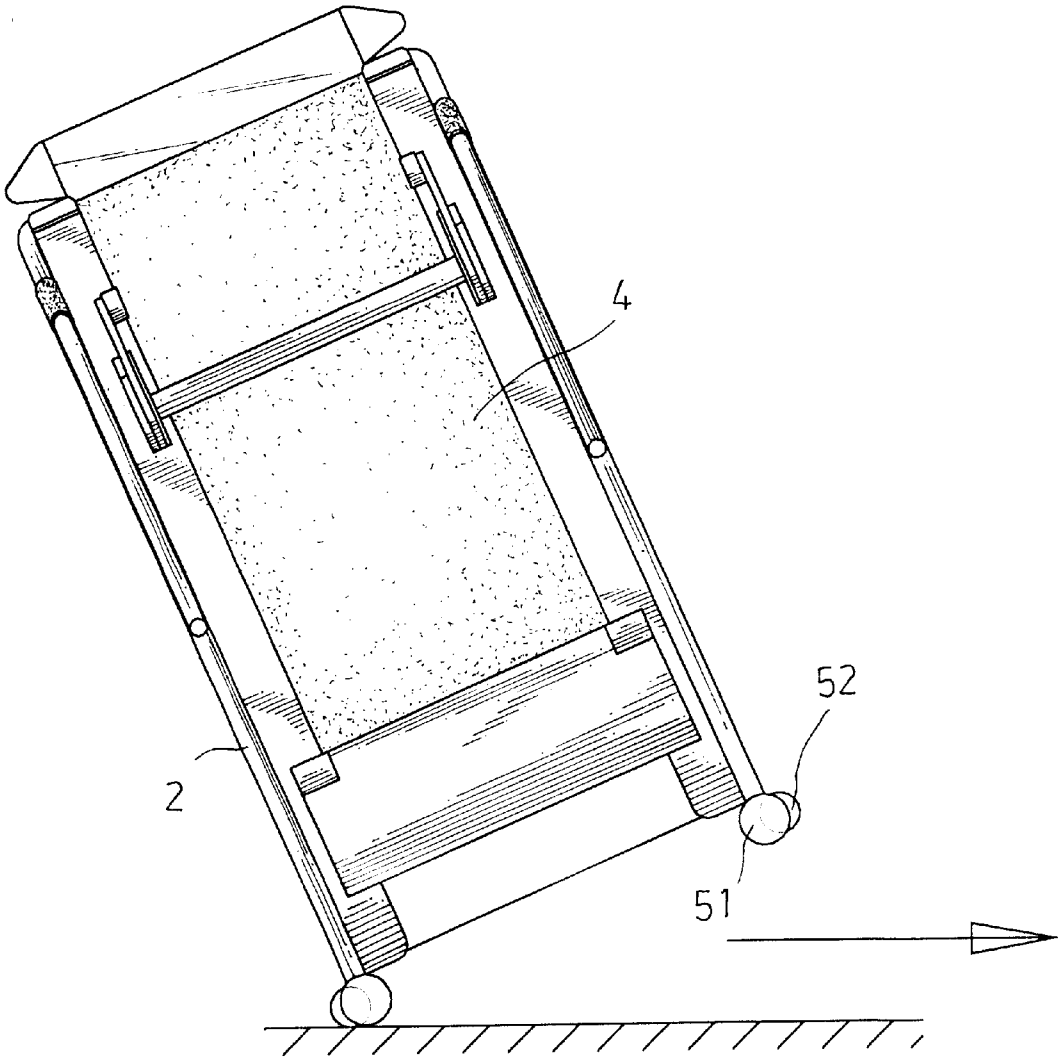
FIG. 6 is plane view to show the treadmill as shown in FIG. 4 is tilted to be moved by the wheels on one of two sides of the treadmill.

Referring to FIG. 6, when moving the folded treadmill of the present invention, the user may tilt the treadmill and rolling the two wheels 52 on one side of the treadmill to conveniently move the treadmill passing through the entrance of a room.

The invention is not limited to the above embodiment but various modification thereof may be made. It will be understood by those skilled in the art that various changes in form and detail may made without departing from the scope and spirit of the present invention.

What is claimed is:

1. A combination of a wheel assembly and a treadmill, said treadmill comprising two stands each having a transverse portion, a continuous belt pivotally connected between said two stands, each transverse portion having two wheels rotatably connected thereto and each wheel having a rotational axis perpendicularly to an axis of said transverse portion corresponding thereto.

2. The combination as claimed in claim 1, wherein each transverse portion comprises a middle tube and two end caps respectively connected to two ends of said middle tube, each of said end caps having a recess defined radially therein so as to receive said wheel corresponding thereto.

3. The combination as claimed in claim 2, wherein each middle tube has a notch defined longitudinally in each one of two ends thereof, said two end caps each having a neck extending therefrom so as to be received in said two ends of said middle tube, each neck having a protrusion extending radially outward therefrom so as to be engaged with said notch corresponding thereto.

4. The combination as claimed in claim 2, wherein each middle tube has at least two holes respectively defined through the wall at two ends thereof and each neck has a positioning hole defined therein, said two holes respectively located in alignment with said positioning holes in said two necks, two pins respectively inserted through said aligned hole and positioning hole.

* * * * *